US005360656A

United States Patent [19]

Rexfelt et al.

[11] Patent Number: 5,360,656

[45] Date of Patent: Nov. 1, 1994

[54] PRESS FELT AND METHOD OF MANUFACTURING IT

[75] Inventors: Jan Rexfelt; Sven-Arne Svensson, both of Halmstad, Sweden

[73] Assignee: Albany International Corp., Albany, N.Y.

[21] Appl. No.: 78,216

[22] PCT Filed: Dec. 17, 1991

[86] PCT No.: PCT/SE91/00868

§ 371 Date: Jun. 15, 1993

§ 102(e) Date: Jun. 15, 1993

[87] PCT Pub. No.: WO92/11411

PCT Pub. Date: Jul. 9, 1992

[30] Foreign Application Priority Data

Dec. 17, 1990 [SE] Sweden ..... 9004009-8

[51] Int. Cl.[5] ..... B32B 23/02

[52] U.S. Cl. ..... 428/193; 28/110; 28/135; 139/383 A; 428/192; 428/225; 428/229; 428/234; 162/358.1

[58] Field of Search ..... 139/383 A; 162/358.1; 428/192, 193, 225, 229, 234; 28/110, 135

[56] References Cited

U.S. PATENT DOCUMENTS

| | | | |
|---|---|---|---|
| 4,271,222 | 6/1981 | Hahn | 428/193 |
| 4,695,498 | 9/1987 | Sarrazin et al. | 428/225 |
| 4,761,329 | 8/1988 | Hälker et al. | 428/225 |

FOREIGN PATENT DOCUMENTS

| | | |
|---|---|---|
| 2044385 | 12/1991 | Canada . |
| 0464258 | 1/1992 | European Pat. Off. . |

*Primary Examiner*—James J. Bell

*Attorney, Agent, or Firm*—Kane, Dalsimer, Sullivan, Kurucz, Levy, Eisele & Richard

[57] ABSTRACT

A press felt is devised for use in a papermaking machine, and a method is provided for manufacturing such a press felt. The press felt comprises a base fabric which is made of fabric of yarn material and is endless in the machine direction of the press felt, and one or more layers of fiber material arranged on the base fabric. The base fabric of the press felt comprises at least one layer composed of a spirally-wound strip made of fabric of yarn material and having a width which is smaller than the width of the final base fabric. Longitudinal threads of the spirally-wound fabric strip of yarn material make an angle with the machine direction of the press felt. The fabric strip of yarn material may advantageously be flat-woven.

18 Claims, 3 Drawing Sheets

FIG. 4
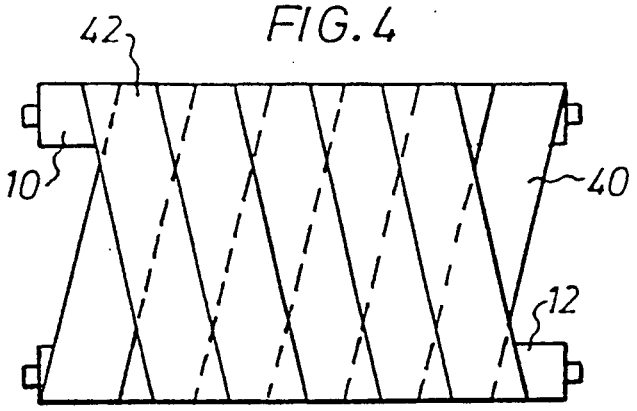
FIG. 5
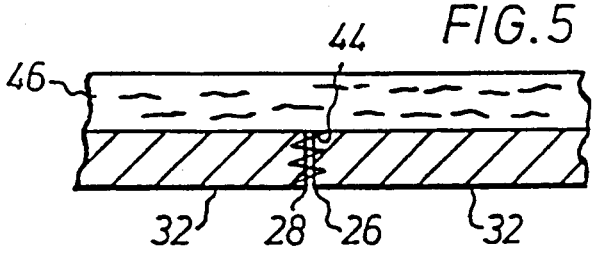
FIG. 6
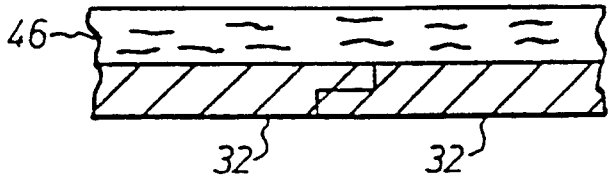
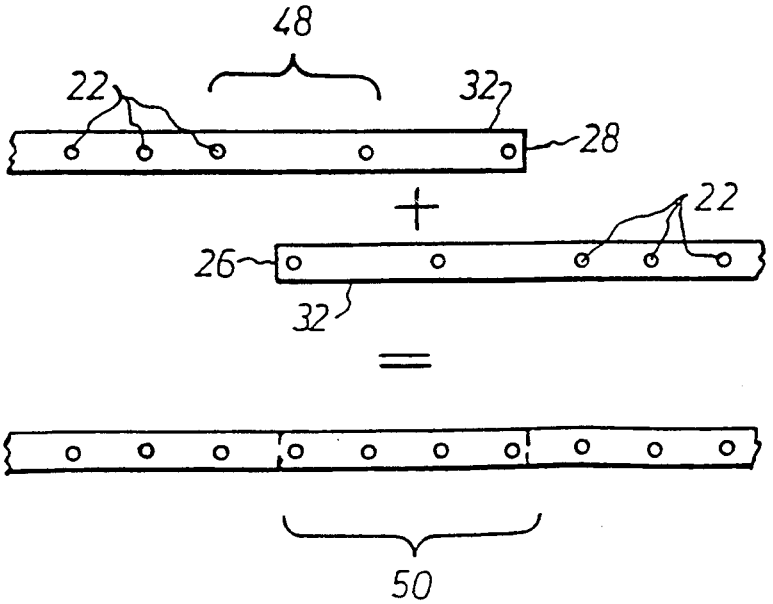
FIG. 7

PRESS FELT AND METHOD OF MANUFACTURING IT

BACKGROUND OF THE INVENTION

The present invention relates to a press felt for use in a papermaking machine, and to a method of manufacturing the press felt, which is of the type comprising a woven base fabric which is made of yarn material and is endless in the machine direction (i.e. in the running direction of the press felt in the papermaking machine), and one or more layers of fiber material arranged on the base fabric.

The term "endless base fabric" as used herein and in the following relates to a base fabric which is closed during operation. The term "endless" should, in particular, be considered also to include the case where the base fabric can be opened across the machine direction for mounting in a papermaking machine, and subsequently joined together by means of a locking seam.

The "fabric of yarn material" as mentioned above may in particular be some type of woven or knitted fabric, and the term "fiber material" includes all types of batt layers and %he like that can be used in a press felt.

Currently, base fabrics for press felts are manufactured mainly by tubular weaving technique which is known to those skilled in the art and according to which the fabric is made in the form of a tube or a hose-pipe and the weft threads are alternately passing into an upper warp thread layer (upper cloth) and a lower warp thread layer (lower cloth). The extent of this "tube" in the transverse direction of the weaving loom thus corresponds to half the length of the final base fabric. The width of the base fabric is determined by the weaving length.

This known technique suffers from the following shortcomings:

1. The length of a tubular-woven base fabric is determined by the reed width in the weaving loom. A tubular-woven base fabric thus has a given length which cannot be modified afterwards and which therefore, during the very weaving operation, must be adjusted to precisely the papermaking machine in which the press felt is to be mounted. Hence, the base fabric and thus the press felt cannot be manufactured and kept in stock in large series, but must be manufactured to a specific order. This extends the delivery time and means low degree of utilisation of the weaving equipment.

2. When adapting a weaving-loom to a longer base fabric, new warp threads must be entered, which not only takes time, but also involves problems in terms of quality, since after such an adaptation of the weaving loom, it is necessary to weave one length of useless base fabric (junk cloth) before the new warp threads will have the correct tension in the fabric.

3. The weaving looms must be given a considerable width, preferably over 20 m to permit tubular weaving of all current lengths of base fabric. The weaving looms therefore become both bulky and expensive.

4. Weaving short base fabrics in a wide weaving loom means low degree of loom utilisation, as well as waste of thread because of the warp threads that are not used, but yet must be fed during the weaving procedure.

5. It is difficult to achieve uniform tension level in the relatively large number of warp threads.

6. At the loom edges where the weaving is directed in either cloth, it is difficult to reach the average yarn density, resulting in irregularities at the loom edges. With such irregularities there is a risk of inducing vibrations during operation and also markings in the paper web.

Hence, there is a current need to solve the problems related above.

SUMMARY OF THE INVENTION

A press felt according to the invention thus comprises an endless base fabric of yarn material, and one or more layers of fiber material arranged on the base fabric. The novel features of the invention reside in that the base fabric comprises at least one layer composed of a spirally-wound fabric strip made of yarn material and having a width which is less than the width of the final base fabric. The fabric strip of yarn material, preferably being a flat-woven strip, has longitudinal threads which in the final base fabric make an angle with the machine direction of the press felt.

During the manufacture of the base fabric, the fabric strip of yarn material is wound or placed spirally, preferably over at least two rolls having parallel axes, to form said layer of the base fabric. Thus, the length of base fabric will be determined by the length of each spiral turn of the fabric strip of yarn material and its width determined by the number of spiral turns.

The number of spiral turns over the total width of the base fabric may vary. The term "strip" as used herein and in the following relates to a piece of material having an essentially larger length than width, the only upper limit of the strip width is that it should be narrower than the width of the final base fabric. The strip width may for example be 0.5–1.5 m, which should be compared with a press felt which may be wider than 10 m.

To avoid markings in the paper web, adjoining portions of the longitudinal edges of the spirally-wound strip are preferably so arranged that the joints or transitions between the spiral turns become completely smooth, i.e. such that the spirally-wound layer has a substantially constant thickness across the entire width of the base fabric.

The spiral turns of the strip need not necessarily be fixed to each other, but preferably there is an edge joint between the adjoining longitudinal edge portions of the spirally-wound strip. The edge joint can be achieved, e.g. by sewing (for instance with water-soluble thread), melting, and welding (for instance ultrasonic welding), of non-woven material, or of non-woven material with melting fibers. The edge joint can also be obtained by providing the fabric strip of yarn material along its two longitudinal edges with seam loops of known type, which can be joined by means of one or more seam threads. Such seam loops may for instance be formed directly of the weft threads, if the strip is flat-woven.

To achieve the smooth transition between the spiral turns, these may be arranged edge to edge or overlappingly. In the latter case, the strip edges must however be so shaped that when being placed so as to overlap each other, they fit into each other without giving rise to any thickness increase at the joint. One way of achieving this is to reduce the thickness of the edges by half as compared with the thickness of the rest of the strip. Another way is to increase the warp thread spacing at the edges and "interlace" the overlapping edges, as will be described in more detail hereinbelow.

According to an embodiment of the invention of particular interest, two or more spirally-wound layers of the above-mentioned type are provided, and of special interest is an embodiment in which the spiral turns in the different layers are placed crosswise, i.e. such that the longitudinal threads of the strip in one layer make an angle both with the machine direction of the press felt and with the longitudinal threads of the strip in another layer.

Other preferred embodiments and features of the invention are recited in the dependent claims. The invention provides the following advantages:

- The weaving loom width can be considerably limited, e.g. to 0.5–1.5 m, giving low investment costs.
- The fabric strip of yarn material, especially a flat-woven one, can be manufactured and kept in stock in considerable lengths (e.g. thousands of meters) before being dispensed from a supply reel and placed spirally into the desired length and width of the base fabric, which spiral arrangement can be achieved in a very short time, e.g. in one day or less. Thus, the delivery time is considerably cut.
- It is easier to maintain a uniform quality over a small strip width, e.g. 0.5–1.5 m, than over the relatively larger width (e.g. 6–20 m) normally used in tubular weaving, this also giving a higher quality to the base fabric layer built up of the strip of yarn material.
- The use of flat-weaving technique gives higher production capacity.
- Variations in the thread tension across the base fabric can be reduced considerably, since the longitudinal threads of the final layer (=warp threads of a flat-woven strip) are not parallel to the machine direction of the press felt. Instead, the tension at each point becomes a mean of the tension in many different longitudinal threads.
- No irregularities are formed at the loom edges during weaving.
- If two layers spirally arranged crosswise are used, particularly interesting advantages are gained, since the longitudinal threads in the upper base layer and in the lower base layer run in mutually different directions. Generally, in a press nip through which the press felt passes for dewatering a paper web, the flow of water in the base fabric occurs substantially parallel to the longitudinal threads. The above-mentioned crossed longitudinal threads means an increased flow resistance, which gives an advantage in and after the press nip. When the press felt passes the press nip, it is compressed, thereafter to expand when leaving the press nip. During the phase of expansion, the water which during the phase of compression has penetrated down into the lower base layer will not as easily return up through the upper base layer to rewet the paper web. In this respect, it may also be noted that two or more such spirally-applied layers can also be made with different thread spacings in the different layers, as is known per se in traditional, tubular-woven base fabrics of the multilayer type, to counteract rewetting.

BRIEF DESCRIPTION OF THE DRAWINGS

The invention will now be described in more detail hereinbelow in some embodiments with reference to the accompanying drawings, in which

FIG. 4 is a highly simplified top plan view illustrating a method of manufacturing a multilayer base fabric according to the invention.

FIG. 5 is an enlarged schematic view of an edge joint between spiral turns of a press felt according to the invention.

FIG. 6 shows a variant of the embodiment in FIG. 5, and

FIG. 7 shows another variant of the embodiment in FIG. 5.

DESCRIPTION OF THE PREFERRED EMBODIMENTS

Figure 1:
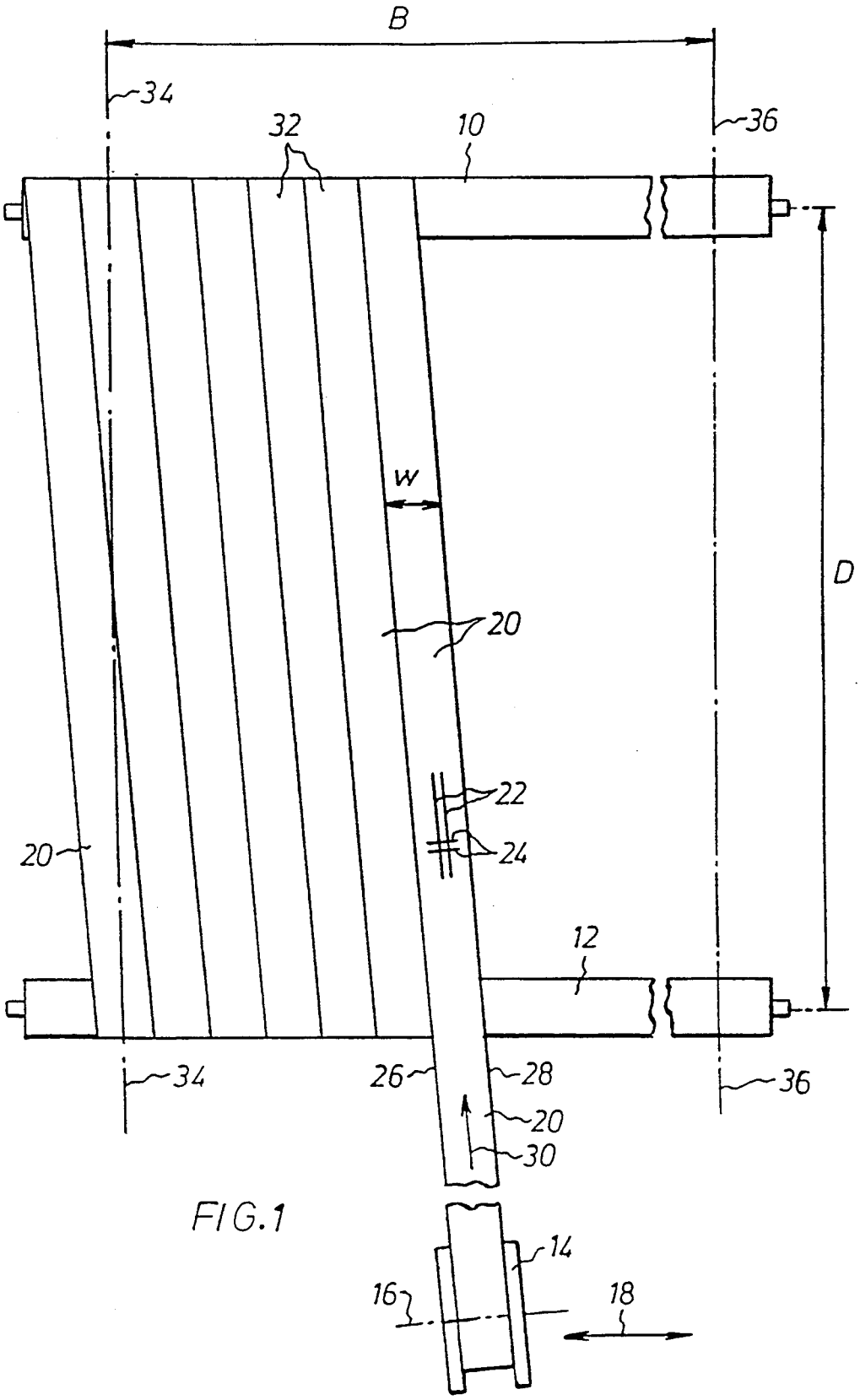
FIG. 1 is a schematic top plan view illustrating a method of manufacturing a base fabric for a press felt according to the invention.
Figure 2:
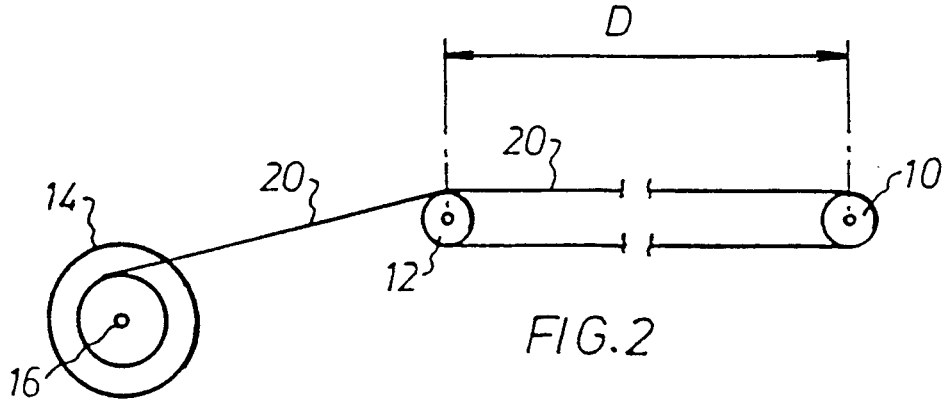
FIG. 2 is a side view corresponding to FIG. 1.

FIGS. 1 and 2, to which reference is now made, illustrate two rotatably mounted rolls 10, 12 having parallel axes spaced from each other by a distance D. At the side of one roll 12, there is provided a supply reel 14 rotatably mounted about an axis 16 and displaceable parallel to the rolls 10 and 12, as indicated by the double arrow 18.

The supply reel 14 accommodates a reeled supply of a flat-woven fabric strip of yarn material 20 having a width w. The flat-woven strip 20 has in known manner two mutually orthoganol thread systems consisting of longitudinal threads (warp threads) and cross threads (weft threads) schematically represented in FIG. 1 at 22 and 24, respectively. Further, the strip 20 has two longitudinal edges 26 and 28, the edges of which are e.g. cut before the strip 20 is wound on to the supply reel 14.

The supply reel 14 is initially applied at the left-hand end of the roll 12 before being continuously displaced to the right at a synchronized speed. As the supply reel 14 is displaced sideways, the strip 20 is dispensed, as indicated by an arrow 30, to be wound spirally about the rolls 10, 12 into a "tube" having a closed circumferential surface. The strip 20 is placed around the rolls 10, 12 with a certain pitch angle, which in the illustrated embodiment is assumed to be so adapted to the strip width w, the distance D between the roll axes and the diameters of the rolls 10, 12, that the longitudinal edges 26, 28 of adjacent "spiral turns" 32 are placed edge to edge (see FIG. 5), so as to provide a smooth transition between the spiral turns 32.

The number of spiral turns 32 placed on the rolls 10, 12 is dependent on the desired width B on the final base fabric. After the spiral winding operation is completed, the edges of the resulting base fabric are cut along the dash-dot lines 34, 36 in FIG. 1 to obtain the width B. The length of the final base fabric essentially is twice the distance D between the roll axes and can therefore easily be varied by changing the distance D.

To prevent the spiral turns 32 already wound on the rolls 10, 12 from shifting on the rolls, it is possible, if so required, for instance to fix the first turn 32 in the longitudinal direction of the rolls.

Figure 3:
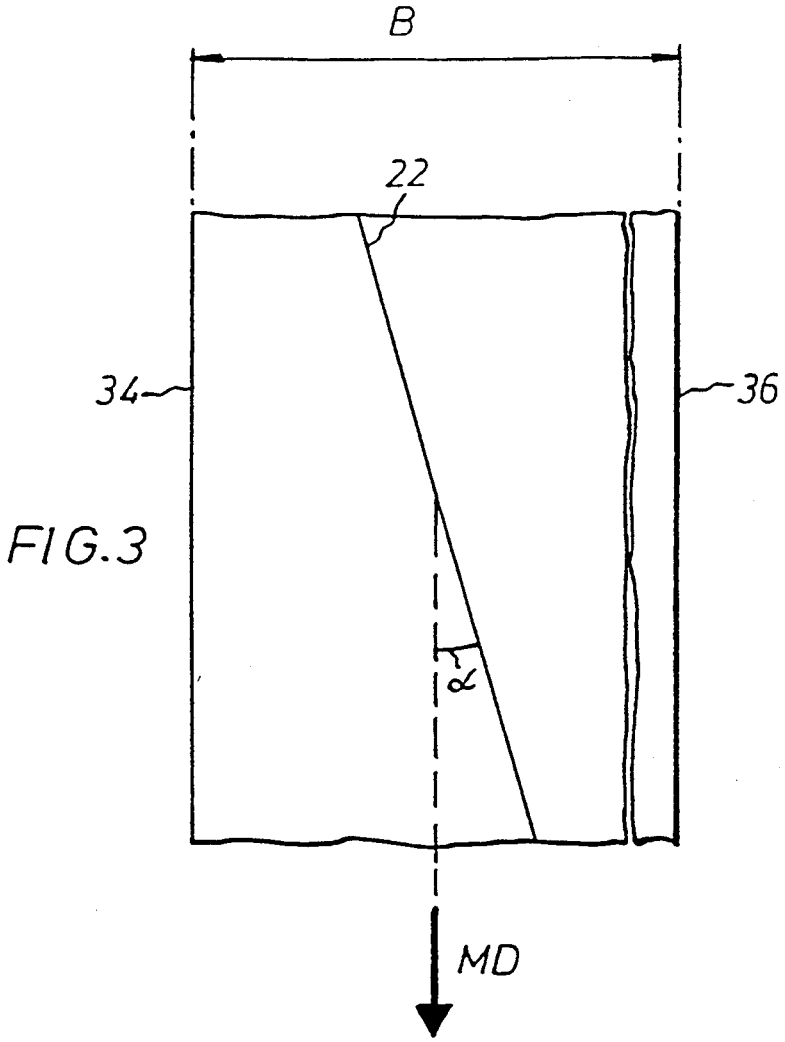
FIG. 3 shows on an enlarged scale a broken-away part of a base fabric made according to FIGS. 1 and 2 and schematically illustrates an angular relation between longitudinal threads in the base fabric.

FIG. 3, to which reference is now made, shows on an enlarged scale a broken-away part of a base fabric produced as shown in FIGS. 1 and 2. Each longitudinal thread (warp thread) 22 of the strip 20 makes an angle a with the machine direction MD of the fabric/press felt. These oblique longitudinal threads 22 run uninterrupted through the entire base fabric layer, whilst the cross threads (weft threads) 24 are interrupted and each have a length w. This is contrary to a traditional tubular-woven endless base fabric, in which the longitudinal threads (which in a tubular-woven fabric consist of the weft threads) are parallel to the machine direction and the cross threads (warp threads) run uninterrupted across the entire width of the base fabric.

FIG. 4 illustrates most schematically, with an exaggerated small distance between the rolls 10, 12 and with an exaggerated large strip width w, an inventive embodiment of particular interest. Two spirally-wound layers 40 and 42 are placed crosswise on each other, optionally setting out from one and the same strip 20. As mentioned above, this embodiment especially yields the advantage of an increased flow resistance occurring, since the longitudinal threads in both layers 40, 42 make an angle with each other. For an embodiment according to FIG. 4, it may be possible in some cases to dispense with the above-mentioned edge joint.

As a variant of the embodiment in FIG. 4, it is also possible to combine a spirally-wound layer of base fabric according to the invention with a traditionally tubular-woven layer of base fabric to form a base fabric of multi-layer type.

For a base fabric of multilayer type, it is further possible in known manner to use different Thread spacings/-structures for the different layers in order to obtain, for example, special dewatering-inhibiting properties.

FIG. 5 schematically shows how the end edges 26, 28 of two juxtaposed spiral turns 32 are in edge-to-edge relationship and joined by sewing, as schematically indicated at 44. FIG. 5 also schematically illustrates a top layer 46 of fiber material, such as a batt layer, arranged on the base fabric, e.g. by needling.

As to the top layer 46 and the needling thereof, it may be mentioned in particular that the top layer can be used for holding together the different layers in a base fabric of multilayer type according to FIG. 4.

FIG. 6 shows an alternative embodiment according to which adjacent longitudinal edge portions of adjoining spiral turns are arranged overlappingly, the edges having a reduced thickness so as not to give rise to an increased thickness in the area of transition.

FIG. 7 shows another variant with overlapping of adjoining edge portions. According to this alternative, the spacing between longitudinal threads is increased at the edges 26, 28 of the strip 20, as indicated at 48, and the longitudinal threads 22 of the edge portions are interlaced. The result is an unchanged spacing between longitudinal threads in the area of transition, as indicated at 50.

We claim:

1. A press felt for a papermaking machine, comprising a woven base fabric which is made of yarn material and is endless in a machine direction of the press felt, and at least one layer of fiber material arranged on the base fabric, wherein said base fabric comprises at least one layer composed of a spirally-wound fabric strip made of yarn material and having a width which is smaller than a width of the base fabric, longitudinal threads of the spirally-wound fabric strip of yarn material making an angle with said machine direction of the press felt.

2. A press felt as claimed in claim 1, wherein the fabric strip of yarn material is flat-woven.

3. A press felt as claimed in claim 1, wherein adjacent longitudinal edge portions of the spirally-wound fabric strip of yarn material are so arranged that said at least one layer of the base fabric has a substantially constant thickness over the entire width of the base fabric.

4. A press felt as claimed in claim 3, wherein said adjacent longitudinal edge portions of the spirally-wound fabric strip of yarn material are arranged edge to edge.

5. A press felt as claimed in claim 3, wherein said adjacent longitudinal edge portions of the spirally-wound fabric strip of yarn material is overlapping.

6. A press felt as claimed in claim 1, further comprising an edge joint provided between adjacent longitudinal edge portions of the spirally-wound fabric strip of yarn material.

7. A press felt as claimed in claim 6, wherein said spirally-wound fabric strip of yarn material is provided along two longitudinal edges thereof with seam loops of known type for providing said edge joint in cooperation with at least one separate seam thread.

8. A press felt as claimed in claim 6, wherein said adjacent longitudinal edge portions of the spirally-wound fabric strip of yarn material are sewn together for providing said edge joint.

9. A press felt as claimed in claim 1, wherein said base fabric also comprises at least one further layer of fabric of yarn material.

10. A press felt as claimed in claim 9, wherein said at least one further fabric layer of yarn material comprises a second layer composed of a spirally-wound fabric strip made of yarn material and having a width which is smaller than the width of the base fabric, longitudinal threads of the spirally-wound fabric strip of yarn material of said second layer making an angle both with the machine direction of the press felt and with said longitudinal threads of the spirally-wound fabric strip of yarn material of the first-mentioned layer.

11. A method of manufacturing a press felt for use in a papermaking machine, said press felt having a base fabric which is made of yarn material and is endless in a machine direction of the press felt, and at least one layer of fiber material arranged on the base fabric, said method comprising the steps of:

(a) manufacturing a fabric strip of yarn material, said fabric strip having longitudinal threads in a longitudinal direction of said fabric strip and presenting a width which is smaller than a width of the base fabric;

(b) spirally winding said fabric strip of yarn material, to form in the base fabric a layer of fabric of yarn material, the longitudinal threads of the spirally-wound fabric strip of yarn material making an angle with said machine direction of the press felt; and (c) fixing said at least one layer of fiber material to the base fabric.

12. A method as claimed in claim 11, wherein the step of spirally winding said fabric strip of yarn material is performed by spirally winding said fabric strip of yarn material about at least two parallel rolls.

13. A method as claimed in claim 11, comprising, prior to the step of fixing said at least one layer of fiber material, a further step of spirally winding said fabric strip of yarn material to form a second layer of fabric of yarn material on the first-mentioned layer of fabric of yarn material.

14. A method as claimed in claim 13, wherein the fabric strip of yarn material in said first-mentioned layer and the fabric strip of yarn material in said second layer are wound mutually crosswise, such that the longitudinal threads of the fabric strip of yarn material in the second layer make an angle both with said machine direction of the press felt and with the longitudinal threads of the fabric strip of yarn material in the first-mentioned layer.

15. A method as claimed in claim 11, comprising, prior to the step of fixing said at least one layer of fiber material, a further step of spirally winding a second fabric strip of yarn material, having longitudinal threads in a longitudinal direction of said second fabric strip and presenting a width which is smaller than said width of the base fabric, to form a second layer of fabric of yarn material on the first-mentioned layer.

16. A method as claimed in claim 15, wherein said first-mentioned fabric strip of yarn material forming said first-mentioned layer and said second fabric strip of yarn material forming said second layer are wound mutually crosswise, such that said longitudinal threads of the second fabric strip of yarn material in the second layer make an angle both with said machine direction of the press felt and with said longitudinal threads of said first-mentioned fabric strip of yarn material in the first-mentioned layer.

17. A method as claimed in claim 11, wherein said fabric strip of yarn material is flat-woven.

18. A method as claimed in claim 15, wherein said second fabric strip of yarn material is flat-woven.

* * * * *

Adverse Decisions in Interference

Patent No. 5,360,656, Jan Rexfelt, Sven-Arne Svensson, PRESS FELT AND METHOD OF MANUFACTURING IT, Interference No. 103,686, final judgment adverse to patentees rendered October 7, 1997, as to claims 1-6 and 9-18.

*(Official Gazette April 21, 1998)*